United States Patent [19]

Horiuchi et al.

[11] Patent Number: 4,487,012

[45] Date of Patent: Dec. 11, 1984

[54] METHOD AND APPARATUS FOR SUPPLYING FLUID TO A TRAVELING-TYPE WORKING MACHINE SERVING A SPINNING FRAME

[75] Inventors: Mitsunori Horiuchi, Kariya; Tatemi Fukuda, Aichi; Shigeru Muramatsu, Okazaki; Takayuki Morita, Kariya, all of Japan

[73] Assignee: Kabushiki Kaisha Toyoda Jidoshokki Seisakusho, Aichi, Japan

[21] Appl. No.: 452,802

[22] Filed: Dec. 23, 1982

[30] Foreign Application Priority Data

Dec. 29, 1981 [JP] Japan ..... 56-214819

[51] Int. Cl.[3] ..... D01H 15/00

[52] U.S. Cl. ..... 57/261; 57/263; 57/276

[58] Field of Search ..... 57/261-263, 57/276, 277

[56] References Cited

U.S. PATENT DOCUMENTS 3,827,226 8/1974 Lesser ..... 57/261

4,102,115 7/1978 Hemala et al. ..... 57/261

*Primary Examiner*—John Petrakes

*Attorney, Agent, or Firm*—Burgess, Ryan & Wayne

[57] ABSTRACT

A method and apparatus for supplying operational fluid to a traveling-type working machine, such as a yarn piecer or an auto-doffer, which serves a parent machine, such as a spinning frame. The working machine utilized in the present invention has a secondary fluid tank and at least one nozzle attached to an air cylinder. Prior to the working machine serving the parent machine, the nozzle is advanced by an air cylinder, operated by fluid supplied from the secondary fluid tank, so that it engages with one of the air intakes provided on the parent machine. Then operational fluid is introduced from a primary fluid source into the working machine through the engaged nozzle and air intake, and thereby the working machine carries out a specific operation for the parent machine. Simultaneously, the operational fluid is distributed to the secondary fluid tank in preparation for the next engagement of the nozzle and the air intake. According to the present invention, the working machine is free from the burden of a heavy and voluminous air compressor and a troublesome long connecting hose.

8 Claims, 3 Drawing Figures

METHOD AND APPARATUS FOR SUPPLYING FLUID TO A TRAVELING-TYPE WORKING MACHINE SERVING A SPINNING FRAME

BACKGROUND OF THE INVENTION

Field of the Invention

This invention relates to a method and an apparatus for supplying operational fluid to a traveling-type working machine serving a parent machine. More specifically, it relates to a method and an apparatus for supplying fluid, such as compressed air, for operating a working machine, such as an auto-doffer or yarn piecer, which travels along the outside side of, a parent machine, such as a spinning frame or a fly frame, so as to serve the parent machine with yarn piecing or package doffing.

In the past, there are two types of fluid supplying systems, one being a system in which a working machine itself has a primary fluid source such as a compressor, the operating fluid being supplied therefrom to operational parts of the working machine, and the other being one in which a primary fluid source is provided in a suitable stationary part of the parent machine, the operational fluid being introduced therefrom into the working machine through a long flexible air hose connected between the primary fluid source and the working machine.

In the former system, since the traveling working machine is loaded with the heavy primary fluid source, the framework of the working machine and the rail thereof must be heavier and stouter than usual, thereby consuming more energy when traveling.

In the latter system, the long flexible hose for introducing the operational fluid into the working machine may disturb the operations of a worker or the working machine and, further, maintenance of the hose is very troublesome.

SUMMARY OF THE INVENTION

It is an object of the present invention to provide a method and apparatus for eliminating the above-mentioned drawbacks.

It is still more specific object of the present invention to provide a method and an apparatus for supplying operational fluid to a traveling-type working machine, thereby the working machine can be of less weight and smaller size as well as free from the burden of a troublesome long connecting hose.

According to the present invention, the above-mentioned object is performed by a method for supplying operational fluid to a working machine, which travels on a rail arranged along the sides of a parent machine, such as a spinning frame, provided with a plurality of spinning units and which serves said parent machine by carrying out a specific operation, said method comprising the steps of:

stopping said working machine in front of one of said spinning units necessitating the service of said working machine, advancing one or more nozzles provided on said working machine, by means of compressed fluid supplied from a secondary fluid tank mounted on said working machine, so as to connect one of said nozzles with an air intake provided on said parent machine along said rail at a predetermined distance therebetween, and supplying operational fluid from a primary fluid source through said connected air intake and nozzle to said working machine so that said working machine can carry out said specific operation, and distributing said operational fluid to said secondary fluid tank.

According to the invention there is also provided an apparatus for supplying operational fluid to a working machine, which travels on a rail arranged along the sides of a parent machine such as a spinning frame, provided with a plurality of spinning units, and which serves said parent machine by carrying out a specific operation, said apparatus being provided, on one hand, on said parent machine, with a plurality of air intakes arranged along said rail at a predetermined distance therebetween and communicating with a fluid source for generating primary compressed fluid, and said apparatus being provided, one the other hand, on said working machine with a secondary fluid tank, at least one nozzle through which said primary compressed fluid is supplied to said working machine, said nozzle being air-tightly engageable with and disengageable from said air intakes by advancing and retracting the displacements of said nozzle, an air cylinder for imparting said displacements to said nozzle with fluid supplied from said secondary fluid tank, and a piping system for distributing said primary compressed fluid to said secondary fluid tank and parts of said working machine so that said working machine can carry out said specific operations.

BRIEF DESCRIPTION OF THE DRAWINGS

Other objects and advantages of the present invention will be apparent from the following description, made with reference to the accompanying drawings, wherein.

DETAILED EXPLANATION OF THE PREFERRED EMBODIMENTS

Figure 1:
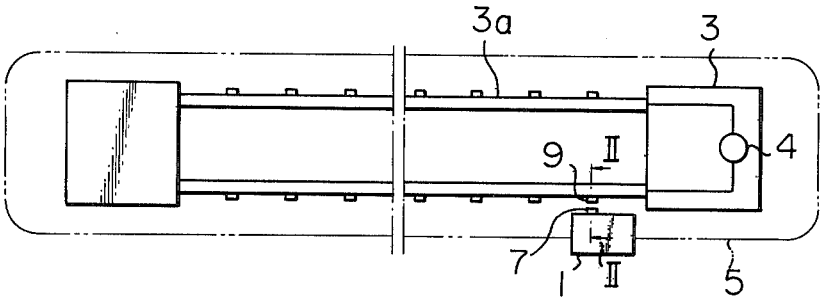
FIG. 1 illustrates a plan view of an embodiment of an apparatus according to the present invention.

In FIG. 1, a working machine 1, such as an automatic yarn piecer or an auto-doffer, travels on a rail 5 arranged along an outer side of the frame 3*a* of a parent machine 3, such as an open-end spinning frame. The working machine 1 stops at a designated point on the rail 5 at a command from the parent machine 3 to carry out a predetermined type of work, such as yarn piecing or doffing.

On the frame 3*a* of the parent machine 3 is provided a fluid source 4, such as a compressor. The fluid source 4 is connected to a plurality of air intakes 9 arranged in the longitudinal direction of the parent machine 3 at points corresponding to each of the spinning units (not shown). Thus, the fluid is readily available to the working machine from air intakes 9.

On a suitable portion of the working machine 1 is provided a nozzle 7 which can engage with a respective air intake 9 when the working machine 1 stops in front of the spinning unit at a position adjacent the respective air intake 9.

Figure 2:
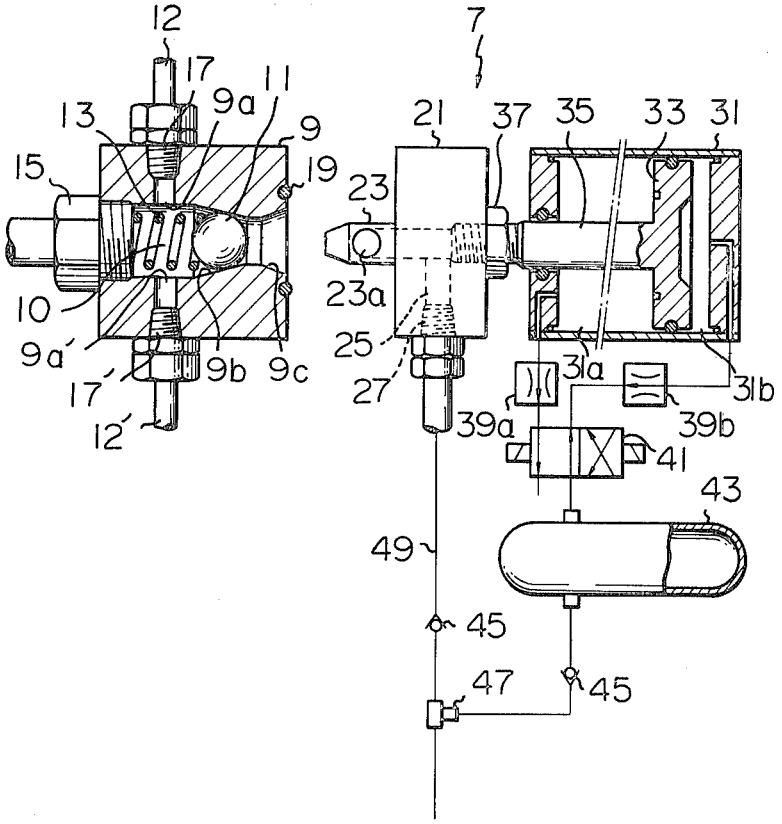
FIG. 2 is an enlarged sectional view along the II—II line shown in FIG. 1.

FIG. 2 shows in detail the structure of the air intake 9, the nozzle 7, and other appurtenants. The air intake 9 has a central chamber 10 communicating with the outside thereof via a converged conical channel 9b and a diverged conical inlet 9c. Inside the central chamber 10 is accomodated a steel ball 11 urged toward the converged wall of the conical channel 9b by a compression spring 13. The opposite end of the central chamber 10 is closed with a screwed peg 15, which also serves as a retainer for the compression spring 13.

In the midportion of the central chamber 10, supply ducts 9a and 9a' for supplying fluid are provided in the wall of the air intake 9. Connecting pipes 12 and 12' are secured to the supply ducts 9a and 9a', respectively, with joints 17 and 17'. Each of the air intakes 9, is connected in series to either the connecting pipe 12 or 12' via the joints 17 and 17' so that the air intakes 9 are ultimately connected with the fluid source. Further, on the front end surface of the air intake 9, an O-ring 19 is disposed around the inlet 9c to air seal it.

The nozzle 7 comprises a joint pin 23 and a head 21 secured to an air cylinder 31 for displacing the head 21. The joint pin 23 protrudes from the head 21 and is engageable with the air intake 9. The joint pin 23 is inserted into the diverged inlet 9c, guided by the slanted inner wall thereof, and pushes the steel ball 11 inwardly against the compression spring 13. The joint pin 23 has a conical shaped tip portion in which is provided a fluid-receiving aperture 23a. The aperture 23a communicates with a joint 27 via a fluid channel 25 formed in the joint pin 23 and the head 21.

The air cylinder 31 comprises a piston 33 and a piston rod 35 mounted on the piston 33. The top of the piston rod 35 is screwed to the head 21 with a nut 37. The interior of the air cylinder 31 is divided into two chambers 31a and 31b, to which is connected a four-port-two-way solenoid valve 41 via regulators 39a and 39b for controlling the displacing speed of the piston 33. The solenoid valve 41 communicates with a secondary fluid tank 43, which is connected to the joint 27 of the head 21 via a check valve 45 and a T-joint 47. The check valve 45 permits airflow to only the secondary fluid tank 43. The opposite end of the T-joint 47 is connected to the driving means for the operational parts of the working machine 1.

The operations of the above-mentioned apparatus according to the present invention will now be explained. The working machine 1 is driven along the frame 3a of the parent spinning machine 3 by a known driving system which is supplied with electric energy by a suitable power supply means (not shown). When a command to carry out an operation, such as doffing or yarn piecing, is issued by a certain spinning unit, the working machine 1 stops in front of the spinning unit at a point where the nozzle 7 confronts an air intake 9 on the parent machine 3.

Then the direction of air flow in the solenoid valve 41 is changed so as to advance the head 21, along with the piston 33 and the piston rod 35 toward the air intake 9, whereby the joint pin 23 is inserted into the inlet 9c and pushes the steel ball 11 back into the chamber 10, and, finally, the front surface of the head 21 closely contacts the O-ring 19 on the air intake 9 so that the area therebetween is air sealed. Compressed air introduced into the central chamber 10 through the joint 17 flows into the nozzle 7 through the aperture 23a and reaches the T-joint 47 through the joint 27, a pipe 49, and the check valve 45. Then the air is distributed in one direction to the secondary fluid tank 43 through a check valve 45' and in another direction to the driving means for the operational parts of the working machine 1.

In the above-mentioned embodiment, since the nozzle 7 is caused to engage with the air intake 9 by the air cylinder 31, the advancing speed of the head 21 can be regulated by the regulator 39a to obtain a suitable operational speed. This results in a safe and reliable engagement of the nozzle 7 with the air intake 9. The slanted inner wall of the inlet 9c enhances the aforementioned result even if the center of the joint pin 23 more or less deviates from that of the inlet 9c because the relative position thereof can be automatically and smoothly corrected by the guiding of the inlet 9c into the joint pin 23.

The use of an air cylinder to displace the nozzle 7 is one feature of the present invention. That is, if an electromagnet is utilized in place of an air cylinder to displace the nozzle 7, it is difficult to obtain the desired design of the apparatus due to the electromagnet's shorter stroke and smaller power. In addition, automatic correction of the deviation of the center of the joint pin 23 mentioned above can be carried out because the operational speed of the electromagnet is too high, thereby necessitating precise positioning of the working machine agiant the parent machine.

Figure 3:
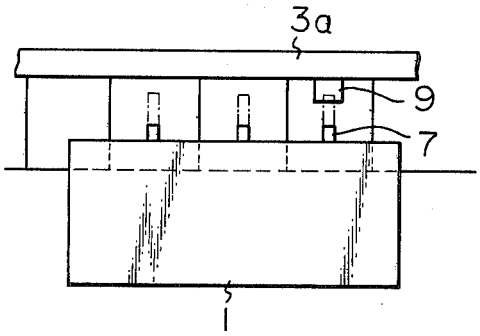
FIG. 3 illustrates a plan view of another embodiment of the apparatus according to the present invention.

In FIG. 3 is shown another embodiment of the apparatus of the present invention in which a working machine 1 has a plurality of nozzles 7 parallelly arranged on a side cofronting the parent frame 3. Prior to the carrying out of a doffing or yarn piecing operation by the working machine 1, all of the nozzles 7 advance simultaneously toward the parent machine 3, and thereby one of the nozzles 7 can engage with an air intake 9 provided on the parent machine 3. According to the embodiment, the number of air intakes can be reduced considerably.

According to the present invention, a working machine can travel freely without being constrained by a long air hose or a heavy and voluminous fluid source. Further, since air is supplied to the secondary fluid tank each time the working machine stops, the air pressure in the fluid tank is maintained substantially constant, and thereby a reliable connection between the nozzle and the air intake can be readily made.

We claim:

1. A method for supplying operational fluid to a working machine, which travels on a rail arranged along the sides of a parent machine, such as a spinning frame, provided with a plurality of spinning units and which serves said parent machine by carrying out a specific operation, said method comprising the steps of stopping said working machine in front of one of said spinning units necessitating the service of said working machine, advancing one or more nozzles provided on said working machine by means of compressed fluid supplied from a secondary fluid tank mounted on said working machine, so as to connect one of said nozzles with one of a number of air intakes provided on said parent machine along said rail at a predetermined distance therebetween, and supplying operational fluid from a primary fluid source through said connected air intake and nozzle to said working machine so that said working machine can carry out said specific operation, and distributing said operational fluid to said secondary fluid tank.

2. An apparatus for supplying operational fluid to a working machine, which travels on a rail arranged along the sides of a parent machine such as a spinning frame, provided with a plurality of spinning units, and which serves said parent machine by carrying out a specific operation, said apparatus being provided, on one hand, on said parent machine with at least one air intake arranged along said rail and communicating with a fluid source for generating primary compressed fluid, and said apparatus being provided, on the other hand, on said working machine with, a secondary fluid tank, at least one nozzle through which said primary compressed fluid is supplied to said working machine, said nozzle being air-tightly engageable with and disengageable from said air intake by advancing and retracting the displacements of said nozzle, an air cylinder for imparting said displacements to said nozzle with fluid supplied from said secondary fluid tank, and a piping system for distributing said primary compressed fluid to said secondary fluid tank and parts of said working machine so that said working machine can carry out said specific operations.

3. An apparatus according to claim 2, in which said secondary fluid tank is connected to said air cylinder via regulators and a solenoid valve.

4. An apparatus according to claim 2, in which said piping system has at least one check valve between said nozzle and said secondary fluid tank.

5. An apparatus according to claim 2, in which each said air intake is arranged so as to correspond to each of said spinning units.

6. An apparatus according to claim 2, wherein said apparatus includes a plurality of air intakes arranged along said rail at a predetermined distance therebetween, said air intakes being arranged the same distance from each other as the corresponding predetermined number of said spinning units.

7. An apparatus according to claim 2, in which said nozzle comprises a head with a joint pin having a conical shaped tip portion and said air intake has a diverged inlet for engagement with said joint pin.

8. An apparatus according to claim 7, in which said diverged inlet leads into a conical channel and a central chamber in which a steel ball is urged toward said conical channel by means of a compression spring, thereby creating an airtight sealing between said ball and said channel.

* * * * *